US006747667B1

(12) United States Patent
Huntington

(10) Patent No.: US 6,747,667 B1
(45) Date of Patent: Jun. 8, 2004

(54) IMAGE STRETCHING

(75) Inventor: Keith J. Huntington, Siler City, NC (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 08/622,038

(22) Filed: Mar. 21, 1996

(51) Int. Cl.[7] ..... G09G 5/00
(52) U.S. Cl. ..... 345/660; 345/667
(58) Field of Search ..... 345/131, 87, 132, 345/133, 660, 671, 667, 3.1, 3.3

(56) References Cited

U.S. PATENT DOCUMENTS 5,351,064 A * 9/1994 Zenda ..... 345/3.1
5,521,614 A * 5/1996 Kotha et al. ..... 345/660

* cited by examiner

*Primary Examiner*—Matthew Luu

(57) ABSTRACT

A method and apparatus for managing image stretching, including text image stretching, on a display panel. A video system for controlling the display panel includes a device (e.g., a video device driver) for indicating if the video system is capable of stretching the image. The video system also includes a second device (e.g., a video BIOS program) for activating the image stretching if it is indicated that the video system is capable of stretching the image. The video system may include a third device (e.g., a video chipset) for stretching an image presented for display on the display panel if image stretching is activated.

43 Claims, 3 Drawing Sheets

IMAGE STRETCHING

BACKGROUND

The invention relates to image stretching.

A high resolution liquid crystal display (LCD) panel has discrete pixels, whereas a traditional analog cathode ray tube (CRT) monitor uses nondiscrete scalable pixels. On a high resolution LCD panel, standard text mode video images use only a portion of the screen rather than the entire viewable area.

Text image stretching is a method in which an original text mode video image of a given resolution and number of pixels is "stretched" (by interpolation) to fill a larger video screen area. This is useful for allowing a smaller amount of video screen information to fill a physically larger screen space for ease of viewing.

As a simple example, a standard video text screen might consist of 640 pixels horizontally by 480 pixels vertically, used to display 80 horizontal characters by 25 vertical characters each 8 pixels wide by 16 pixels high. For a physical screen capable of a larger number of pixels, such as a super VGA (SVGA) LCD display with a resolution of 800 horizontal by 600 vertical pixels, the text screen would fill only 80% of the physical screen, leaving 20% of the screen unused. Text stretching would stretch all the characters, perhaps to 10 pixels horizontal by 20 pixels vertical, to fill the entire physical video screen area. No additional information is displayed, but the entire display is used.

Typically, there is no interaction between the video device driver and the video BIOS in a computer system with respect to text image stretching, as the video device driver controls graphics display, not text display. Text image stretching is activated when the video BIOS in the computer system programs special registers in the video chipset. The special registers indicate if text stretching has been activated, the dimensions of the stretch, and the algorithm used to perform the stretch. The video BIOS can activate text image stretching either automatically or in response to a command entered by a user through a user interface such as a keyboard. Once activated, the video chipset will perform the text image stretching when a text image is presented for display. Text stretching can be deactivated by the user, which will cause the video BIOS to clear the special registers.

SUMMARY

In general, in one aspect, the invention features a method of managing stretching of an image on a display panel of a computer system. The method includes setting a stored value to indicate if the computer system is capable of stretching the image and checking the value prior to image stretching. If the value is set indicating the computer system is capable of stretching the image, then image stretching is activated.

Certain implementations of the invention include one or more of the following features. The image presented for display on the display panel is stretched if image stretching is activated. The display panel includes a non-scalable pixel array or a liquid crystal display panel. The value includes a register bit. The computer system includes a video system for controlling the display panel and for setting the value. The video system includes a video device driver for setting the value, and the value is set within a hardware video driver. The value is set if a video device driver specific to the hardware video driver is available, and the hardware video driver includes a video chipset or a register for storing the value. The value is checked by video firmware, which includes a video BIOS program. The image stretching includes text image stretching.

In general, in another aspect, the invention features a video system for controlling an image on a display panel of a computer system. The video system includes a device for setting a value to indicate if the video system is capable of stretching the image. The video system further includes a second device for checking the value and activating the image stretching if the value is set indicating the video system is capable of stretching the image.

Certain implementations of the invention include one or more of the following features. The video system includes a third device for stretching an image presented for display on the display panel if image stretching is activated. The display panel includes a non-scalable pixel array or a liquid crystal display panel. The value includes a register bit. The first device includes a video device driver. The video system further includes a hardware video driver in which the value is set. The value is set if a video device driver specific to the hardware video driver is available, and the hardware video driver includes a video chipset or a register for storing the value. The second device includes video firmware, which includes a video BIOS program. The image stretching includes text image stretching.

In general, in another aspect, the invention features a computer system including a display panel and a video system for controlling an image on the display panel. The video system includes a device for setting a value to indicate if the video system is capable of stretching the image. The video further includes a second device for checking the value and activating the image stretching if the value is set indicating the video system is capable of stretching the image.

Certain implementations of the invention include one or more of the following features. The video system includes a third device for stretching an image presented for display on the display panel if image stretching is activated. The display panel includes a non-scalable pixel array or a liquid crystal display panel. The value includes a register bit. The first device includes a video device driver. The video system further includes a hardware video driver in which the value is set. The value is set if a video device driver specific to the hardware video driver is available, and the hardware video driver includes a video chipset or a register for storing the value. The second device includes video firmware, which includes a video BIOS program. The computer system includes a hard disk drive for initially storing the video device driver. The computer system also includes a keyboard on which a user can enter a command to cause the second device to activate image stretching if the value is set indicating the video system is capable of stretching the image. The image stretching includes text image stretching.

In general, in another aspect, the invention features a video system for controlling an image on a display panel of a computer system. The video system includes a device for indicating if the video system is capable of stretching the image. The video system further includes a second device for activating the image stretching if the first device indicates the video system is capable of stretching the image.

Certain implementations of the invention include one or more of the following features. The video system includes a third device for stretching an image presented for display on the display panel if image stretching is activated. The display panel includes a liquid crystal display panel. The first device includes a video device driver, and the second device includes video firmware.

Certain implementations of the invention have one or more of the following advantages. Text image stretching can be activated on all platforms on which a custom video device driver can be developed. An "interlock" is provided from the video device driver to the video BIOS to enable the video BIOS to safely activate text image stretching without risking damage to the display panel.

Other advantages and features will become apparent from the following description and from the claims.

DESCRIPTION

Figure 1:
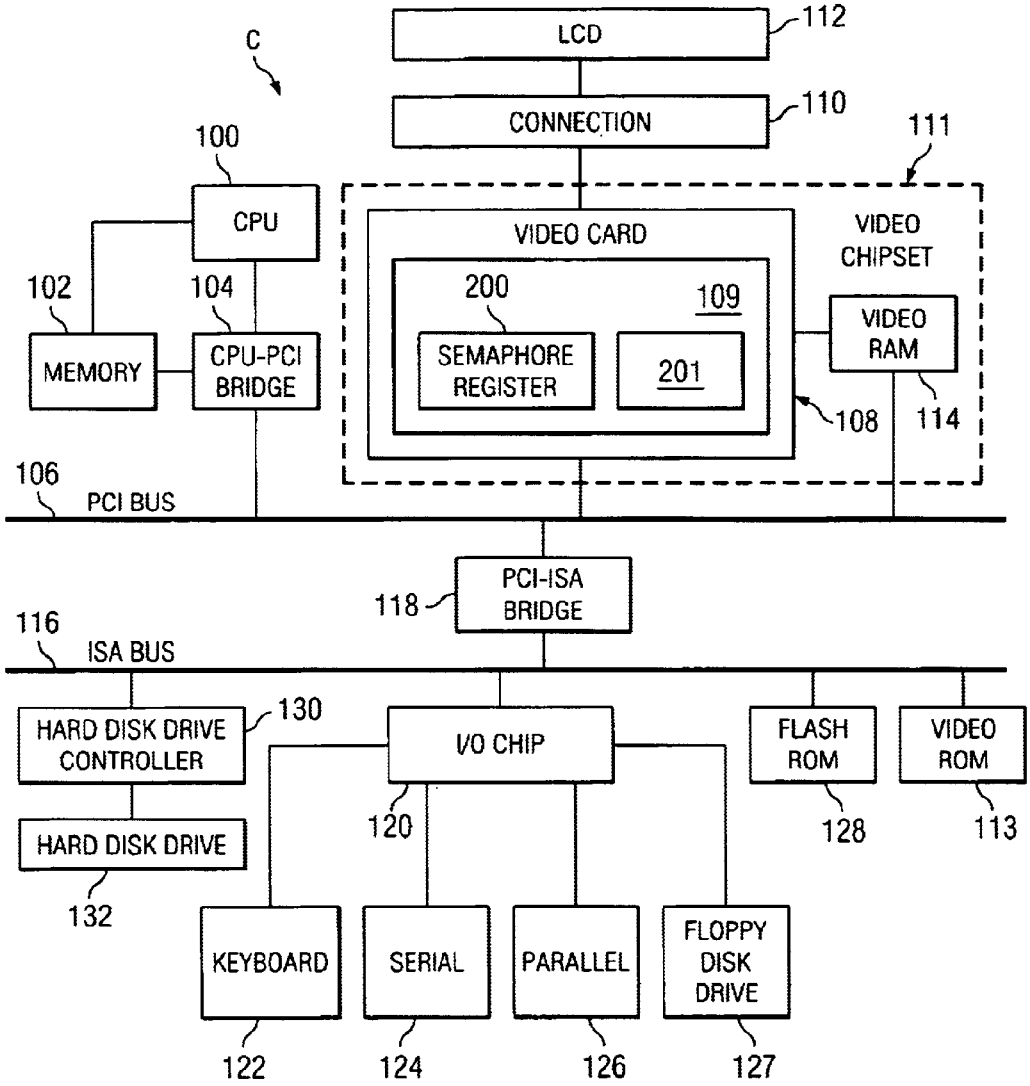
FIG. 1 is a block diagram of a computer system.

Referring to FIG. 1, a computer system C includes a central processing unit (CPU) 100 connected to a main memory 102. The CPU 100 communicates with a Peripheral Component Interconnect (PCI) bus 106 through a CPU-PCI bridge 104. The CPU-PCI bridge 104 includes a memory controller for the main memory 102. Also connected to the PCI bus 106 is a video chipset 111, e.g., CL7543 from Cirrus Logic, which includes a video card 108 for controlling video signals provided to a liquid crystal display (LCD) panel 112, e.g., one having a resolution of 800 by 600, through a connector 110. The video card 108 is connected to a video random-access memory (RAM) 114, which stores the video data for display on the LCD panel 112. The video card 108 also includes a set of video registers 109, which are programmed by the video BIOS to enable certain video modes, including text image stretch mode.

Devices connected to the PCI bus 106 communicate with an Industry Standard Architecture (ISA) bus 116 through a PCI-ISA bridge 118. Also connected to the ISA bus 116 is an I/O chip 120, which controls a keyboard 122, a serial port 124, a parallel port 126, and a floppy disk drive 127. The ISA bus 116 is also connected to a hard disk controller 130 (for controlling a hard disk drive 132), a flash read-only memory (ROM) 128 (for storing the system BIOS), and a video ROM 113 (for storing the video BIOS that controls power-up functions for the video chipset 111).

Figure 2:
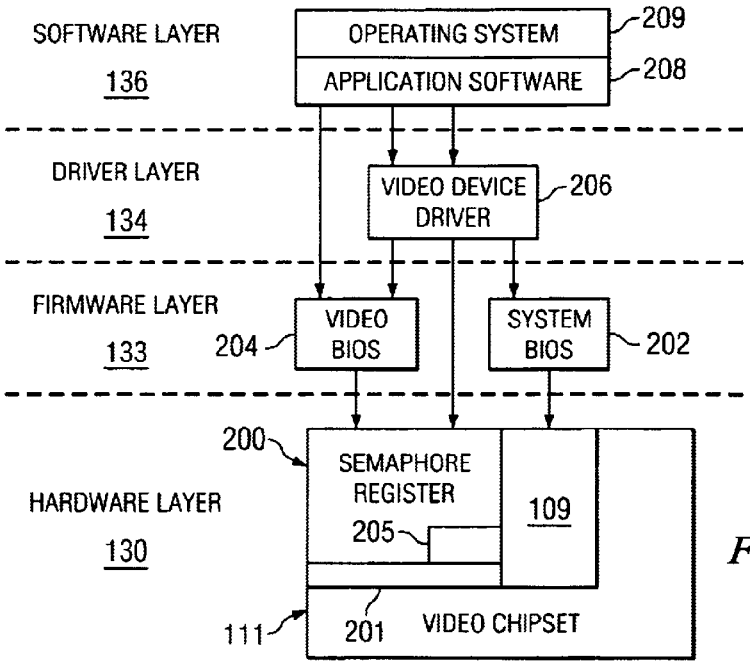
FIG. 2 is a block diagram of the layers in the computer system.

Referring to FIG. 2, with respect to video control, the computer system C may be thought of as made up of 4 layers: a hardware layer 130; a firmware layer 133; a driver layer 134; and a software layer 136. The hardware layer 130 includes the hardware devices shown in FIG. 1. The set of registers 109 in the video chipset 111 (FIG. 1) include a special semaphore register 200 and special text stretch registers 201. The firmware layer 133 includes the video BIOS 204 and a system BIOS 202 (located in the video ROM 113 and the flash ROM 128, respectively).

The driver layer 134 includes a video device driver 206 that acts as the interface between the computer operating system 209 and the video chipset 111. The special semaphore register 200 stores a text stretch enable bit 205 for indicating if the video system, including the video BIOS 204, the video device driver 206, and the video chipset 111, is capable of performing text image stretching safely, as explained in the next paragraph. If the text stretch enable bit 205 is set, then the video BIOS 204 can program the special text stretch registers 201 to activate text image stretching in response to a command entered by the user. Once text image stretching is activated, text images presented for display continue to be stretched until text image stretching is deactivated by the user.

The video device driver 206 can be a generic video device driver (e.g., a VGA device driver) or a chipset-specific video device driver designed specifically for the video chipset 111. In the case of a chipset-specific video device driver, the driver is constructed to be aware of the special text stretch registers 201 and to set the text stretch enable bit 205. A generic video device driver is not aware of the special text stretch registers 201 and the semaphore register 200; thus, it cannot safely handle text stretch without risking damage to the LCD panel 112. By ensuring that a chipset-specific video device driver is loaded before enabling text image stretching, possible damage to the LCD panel 112 is avoided. The components of the LCD panel 112 might be damaged (by overscanning the pixels or applying an overvoltage to the pixels, for example), if the special text stretch registers 201 are not handled properly by the video device driver 204. The text stretch enable bit 205 in the semaphore register 200 effectively provides an "interlock" between the video device driver 206 and the video BIOS 204 to let the video BIOS 204 know if it is "safe" to activate text image stretching.

Above the driver layer 134 is the software layer 136, which includes application software 208 running under the operating system 209.

Figure 3:
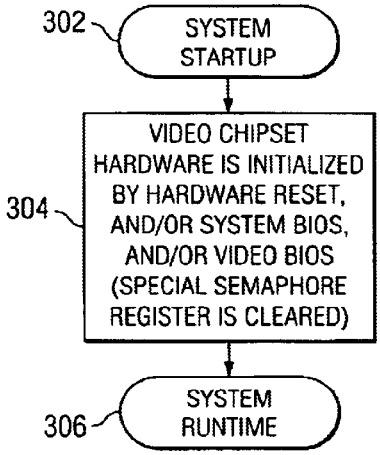
FIG. 3 is a flow diagram of computer system startup functions.

Referring to FIG. 3, when the computer system C is powered on, the system BIOS 202 running in the computer system C performs startup functions 302, including invoking the video BIOS 204. Next, the video chipset 111 is reset 304 to an initial condition, which can be done by a hardware reset or software reset under the control of the system BIOS 202 or the video BIOS 204. The reset clears the contents of the semaphore register 200, including the text stretch enable bit 205. Clearing the enable bit 205 puts the system in a mode in which text stretch is not enabled. The system BIOS 202 then proceeds to perform 306 system run-time functions.

Figure 4:
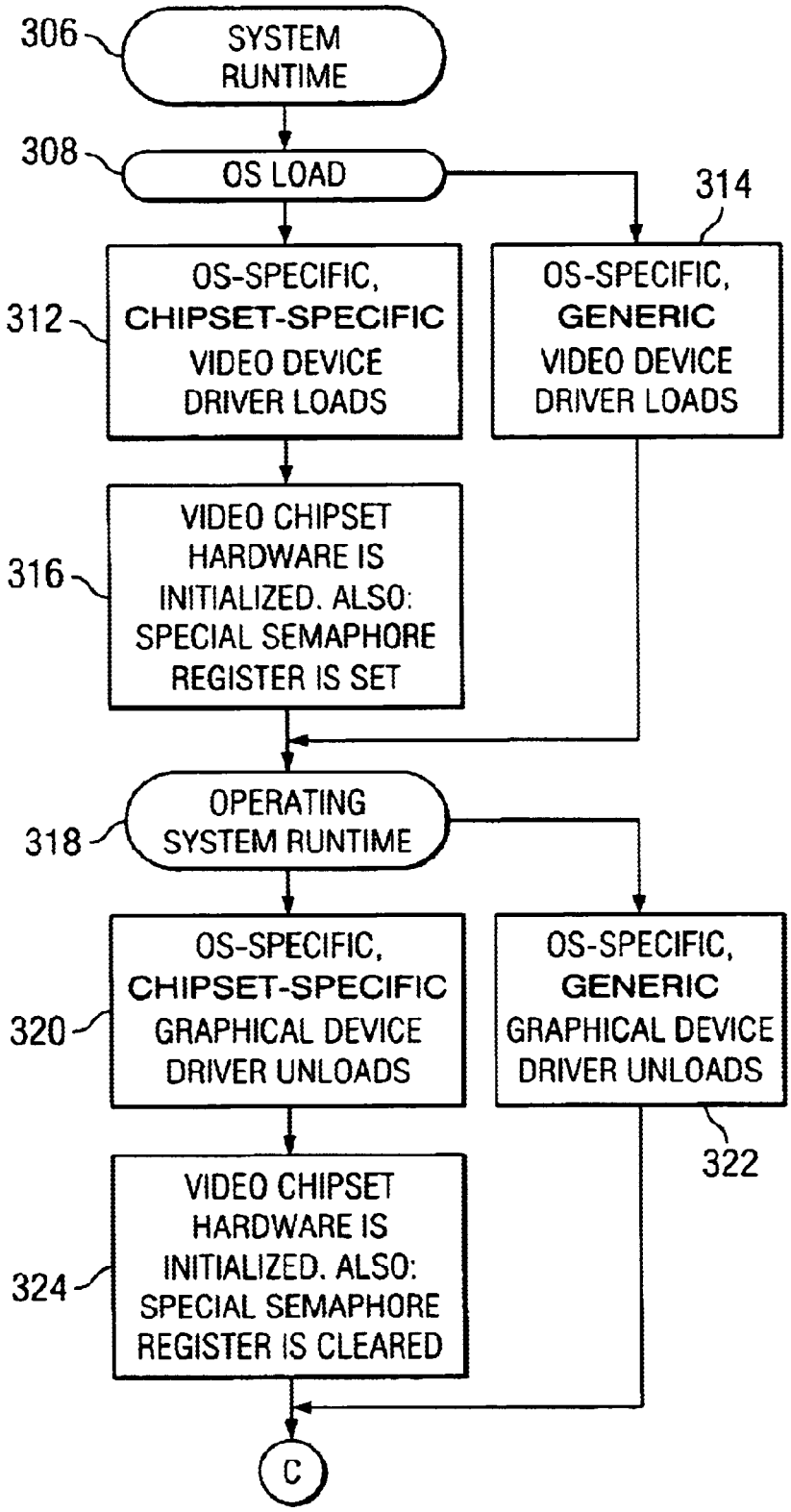
FIG. 4 is a flow diagram of computer system run-time functions.

Referring to FIG. 4, during system run-time, the operating system 209 (FIG. 2) is loaded 308 into the memory 102 (FIG. 1). The operating system 209 checks an initialization file to determine the device drivers, including the video device driver 206, that are to be loaded into the memory 102. The initialization file and the device drivers may be initially stored on the hard disk drive 132. The operating system 209 comes with a list of generic device drivers which are used unless the user sets up the initialization file with special device drivers. If a chipset-specific video device driver 206 Is used, then the chipset-specific video device driver 206 is loaded 312 into the memory 102, the text stretch enable bit 205 in the semaphore register 200 is set 316 by the video device driver 206 to the active state, and the operating system 209 is started 318. Otherwise, if only a generic video device driver 206 is used, then it is loaded 314 into the memory 102 and the operating system is started 318, with the text stretch enable bit remaining in the cleared state.

Following run-time, upon shutdown of the operating system 209, if a chipset-specific video device driver is installed, the device driver 206 is unloaded 320 and the video chipset 111 is re-initialized 324, which includes clearing the semaphore register 200. If a generic video device driver 206 was used instead, then it is unloaded 322 from the memory 102 and the semaphore register 200 remains in the cleared state.

Thus, at run-time the computer system is either in a text-stretch enabled state (i.e., the chipset is capable of text stretch and has its bit 205 set and the chipset-specific video driver is loaded) or in a text-stretch disabled mode (i.e., bit 205 is cleared and a generic video driver or no video driver is loaded).

Figure 5:
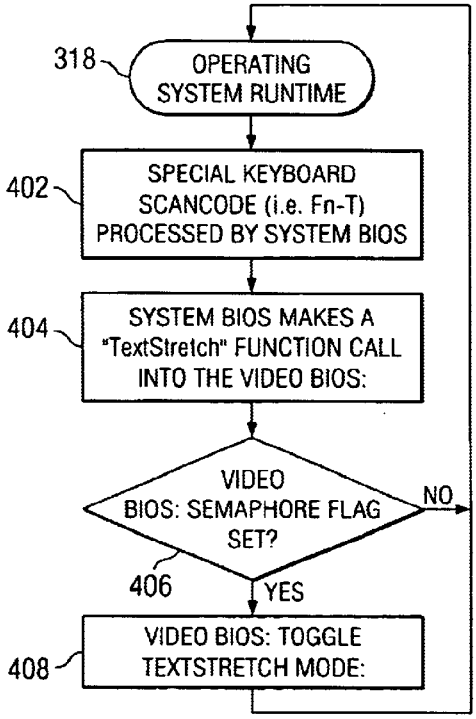
FIG. 5 is a flow diagram of operating system run-time functions.

The operating system 209 controls communication between components in the computer system C. For example, commands entered through the keyboard 122 are received by the operating system and routed to the appropriate destination for handling. One of the commands is a special keyboard scan code, e.g., the "Function-T" command, which is entered by the user to request text stretch mode. Referring to FIG. 5, if the operating system receives the "Function-T" command, It routes the command to the system BIOS 202 for processing 402. In response to the command, the system BIOS 202 makes 404 a text stretch function call, e.g., INT10, func XX, to the video BIOS 204. The video BIOS 204 checks 406 to determine if the text stretch enable bit 205 in the semaphore register 200 is set. If set, the video BIOS 204 activates 408 stretch mode by programming the video registers 109 in the video chipset 111 to the appropriate state. If the text stretch enable bit 205 is not set, then the video BIOS 204 assumes that a non-chipset-specific video device driver or no video driver is loaded and will not activate stretch mode.

Once text-stretch mode is set, text images that are sent to the video chipset 111 for display are automatically subjected to text stretch. When in text stretch enabled state, the user can control whether text stretch is actually activated or not. The user may terminate text stretch mode by issuing the "Function-T" command. When that occurs, the video BIOS 204 re-programs the video registers 109 in the video chipset 111 to toggle out of text stretch mode.

Other embodiments are within the scope of the following claims. For example, rather than requiring a special keyboard scan code issued by the user to enter text stretch mode, the video BIOS can automatically activate text stretch mode if the text stretch enable bit is set active.

What is claimed is:

1. A method of managing stretching of an image on a display panel of a computer system including a video system, comprising:

checking whether or not the video system can support image stretching and, if so, setting a stored value to a condition to indicate that an image is stretchable by the computer system;

prior to image stretching activation, checking the condition of the value; and activating the image stretching only if the value is set to said condition indicating that the image is stretchable by the computer system.

2. The method of claim 1, further comprising:

stretching an image presented for display on the display panel if image stretching is activated.

3. The method of claim 1, wherein the display panel includes a non-scalable pixel array.

4. The method of claim 1, wherein the display panel includes a liquid crystal display panel.

5. The method of claim 1, wherein the condition of the value is represented by the state of a register bit.

6. The method of claim 1, wherein the wherein checking whether or not the video system can support image stretching includes identifying a video driver, said identified video driver setting the stored value to said condition if the identified driver supports image stretching but does not set the stored value to said condition if the identified driver does not support image stretching.

7. The method of claim 1, wherein the value is set to said condition within a hardware video driver.

8. The method of claim 7, wherein the value is set to said condition if a video device driver specific to the hardware video driver is available.

9. The method of claim 7, in which the hardware video driver comprises a video chipset.

10. The method of claim 7, wherein the video driver includes a register for storing the condition of said value.

11. The method of claim 1, wherein the condition of the value is checked by video firmware.

12. The method of claim 11, wherein the video firmware includes a video BIOS program.

13. The method of claim 1, wherein the image stretching includes text image stretching.

14. A computer system including a video system for controlling an image on a display panel, comprising:

an operating system;

a register bit;

a video device driver program;

said operating system operable to check the video device driver program and to cause the video device driver program to set the register bit to a predetermined state if the video system can support image stretching and operable not to set the register bit to said predetermined state if the video system does not support image stretching;

a video BIOS for activating the image stretching only if the register bit is set to said predetermined state; and a video hardware driver for stretching an image presented for display on the display panel if image stretching is activated.

15. The computer system of claim 14, wherein the display panel includes a non-scalable discrete pixel array.

16. The video system of claim 14, wherein the display panel includes a liquid crystal display panel.

17. The computer system of claim 14, further comprising:

a video chipset functioning as an interface between the video device driver and the display panel.

18. The computer system of claim 17, wherein the video chipset includes a set of registers programmed by the video firmware to activate the image stretching.

19. The computer system of claim 14, wherein the image stretching includes text image stretching.

20. The computer system of claim 14, wherein the operating system is operable to check the video device driver during an initialization procedure.

21. A computer system, comprising:

a display panel; and a video system for controlling an image on the display panel, including:

logic operable to check whether or not the video system can support image stretching;

a first device responsive to said logic determining that the video system can support image stretching to set a stored value to a condition to indicate that the video system is enabled for image stretching; and a second device for checking the value and activating the video system for image stretching if the stored value is set to said condition but not activating the video system for image stretching if the stored value is not set to said condition.

22. The computer system of claim 21, further comprising:

a third device for stretching an image presented for display on the display panel if said image stretching is activated.

23. The computer system of claim 21, wherein the display panel includes a non-scalable discrete pixel array.

24. The computer system of claim 21, wherein the display panel includes a liquid crystal display panel.

25. The computer system of claim 21, wherein the condition of said stored value is represented by a register bit.

26. The computer system of claim 21, wherein the first device includes a video device driver.

27. The computer system of claim 21, further comprising:

a hardware video driver in which the condition of the stored value is set.

28. The computer system of claim 27, wherein the condition of the stored value is set if a video device driver is specific to the hardware video driver.

29. A The computer system of claim 27, wherein the hardware video driver includes a video chipset.

30. The computer system of claim 27, wherein the hardware video driver includes a register for storing the condition of said value.

31. The computer system of claim 21, wherein the second device includes video firmware.

32. The computer system of claim 31, wherein the video firmware includes a video BIOS program.

33. The computer system of claim 31, wherein the first device includes a video device driver.

34. The computer system of claim 31, further comprising:

a video chipset functioning as an interface between the video device driver and the display panel.

35. The computer system of claim 34, wherein the video chipset stretches an image presented for display on the display panel only if image stretching is activated.

36. The computer system of claim 34, wherein the video chipset includes a set of registers programmed by the video firmware to activate the image stretching.

37. The computer system of claim 33, further comprising:

a hard disk drive for initially storing the video device driver.

38. The computer system of claim 21, further comprising:

a keyboard on which a user can enter a command to cause the second device to activate image stretching if the value is set to said condition indicating the video system is capable of stretching the image.

39. The computer system of claim 21, wherein the image stretching includes text image stretching.

40. The computer system of claim 21, wherein said logic is operable under control of a computer system operating system during a system initialization procedure.

41. A method of managing stretching of an image on a display under control of a video system, comprising:

checking independently of said display whether or not the video system is capable of performing image stretching of a displayed image and, if so, setting a stored value to a condition to enable image stretching by the video system;

prior to image stretching activation, checking the condition of the value; and activating image stretching by the video system only if the value is set to said condition.

42. A method of managing stretching of an image on a display of an operating system controlled computer system including a video system, comprising:

effecting an operating system check to determine whether or not the video system includes a video device driver program to permit image stretching of a displayed image and, if so, setting a stored value to a condition to enable image stretching by the video system;

in response to an image stretching activation command, checking the condition of the stored value; and activating the video system to effect image stretching image stretching if the stored value is set to said condition and not activating the video system to effect image stretching if the stored value is not set to said condition.

43. A method of managing stretching of an image on a display of an operating system controlled computer system including memory and a video system, comprising:

effecting operating system loading of a video device driver program into the memory and (i) if the video device driver enables the video system to support image stretching of a displayed image, setting a stored value to a first condition, (ii) if the video device driver program does not enable the video system to support image stretching of a displayed image, clearing the stored value; and in response to an image stretching activation command, activating the video system to perform image stretching only if the value is set to said first condition.

* * * * *